US009844861B2

(12) United States Patent
Wang

(10) Patent No.: US 9,844,861 B2
(45) Date of Patent: Dec. 19, 2017

(54) SCREWDRIVER

(75) Inventor: Weiyi Wang, Hangzhou (CN)

(73) Assignees: Hangzhou Great Star Industrial Co., LTD, Hangzhou, Zhejian (CN); Hangzhou Great Star Tools Co., LTD, Hangzhou, Zhejian (CN)

( * ) Notice: Subject to any disclaimer, the term of this patent is extended or adjusted under 35 U.S.C. 154(b) by 774 days.

(21) Appl. No.: 13/582,102

(22) PCT Filed: Jan. 11, 2012

(86) PCT No.: PCT/CN2012/070220
§ 371 (c)(1),
(2), (4) Date: Sep. 18, 2013

(87) PCT Pub. No.: WO2012/095000
PCT Pub. Date: Jul. 19, 2012

(65) Prior Publication Data

US 2014/0196575 A1 Jul. 17, 2014

(30) Foreign Application Priority Data

Jan. 11, 2011 (CN) ..... 2011 1 0003968
Jan. 11, 2011 (CN) ..... 2011 2 0006571 U

(51) Int. Cl.
*B25B 15/04* (2006.01)
*B25B 13/46* (2006.01)
(Continued)

(52) U.S. Cl.
CPC ..... *B25B 15/04* (2013.01); *B25B 13/465* (2013.01); *B25B 15/00* (2013.01); *B25B 23/0035* (2013.01); *B25G 1/085* (2013.01)

(58) Field of Classification Search
CPC ..... B25B 13/463; B25B 13/461; B25B 13/46; B25B 13/465; B25B 15/04; B25B 23/0035; B25B 15/00; B25G 1/085
See application file for complete search history.

(56) References Cited

U.S. PATENT DOCUMENTS 3,750,729 A * 8/1973 Lemieux ..... B25G 1/085 401/31
6,134,995 A 10/2000 Shiao
(Continued)

FOREIGN PATENT DOCUMENTS

CN 36200634 U 12/1986
CN 2071111 U 2/1991
(Continued)

OTHER PUBLICATIONS

International Search Report from PCT/CN2012/070220 dated Apr. 19, 2012.

*Primary Examiner* — Robert Scruggs
(74) *Attorney, Agent, or Firm* — Ohlandt, Greeley, Ruggiero & Perle, L.L.P.

(57) ABSTRACT

A screwdriver, including driver bit sleeve, revolving wheel-shaped driver bit holder and pushrod, the revolving wheel-shaped screwdriver bit holder is rotatably arranged at the rear side of the driver bit sleeve, the revolving wheel-shaped driver bit holder is distributed with axial containing hole containing driver bit and the containing hole can be turned to axially coincide with the inner hole of the driver bit sleeve; pushrod is arranged at the rear side of the revolving wheel-shaped driver bit holder and axially coincides with the inner hole of the driver bit sleeve, the inner hole of the driver bit sleeve includes torque transmission segment at the front part and guiding segment at the rear part, the hole wall of the guiding segment is arranged as guiding surface; and it can also include handle, pushbutton set, pushrod which extends into one of containing holes of driver bit holder when pushbutton set is positioned at first positioning portion of the front part of slideway on the handle, pushing the driver bit in the containing hole toward the driver bit sleeve on the handle until the driver bit extends out of the driver bit sleeve, and the pushrod is positioned at the rear side of the driver bit holder when the pushbutton set is positioned at the rear part of the slideway on the handle and take the corresponding driver bit back into the corresponding containing hole. Fewer constituent parts, simple structured, easy to replace the driver bit.

37 Claims, 12 Drawing Sheets

(51) Int. Cl.

| | |
|---|---|
| ***B25B 15/00*** | (2006.01) |
| ***B25G 1/08*** | (2006.01) |
| ***B25B 23/00*** | (2006.01) |

(56) References Cited

U.S. PATENT DOCUMENTS

| | | | | |
|---|---|---|---|---|
| 6,138,537 | A | 10/2000 | Cole | |
| 6,928,908 | B1 * | 8/2005 | Yu | B25B 15/04 81/177.4 |
| 7,028,593 | B1 | 4/2006 | Lin et al. | |
| 7,562,606 | B2 * | 7/2009 | Grand | B25G 1/085 483/57 |
| 2007/0289418 | A1 * | 12/2007 | Rodgers | B25F 1/04 81/439 |

FOREIGN PATENT DOCUMENTS

| | | | |
|---|---|---|---|
| CN | 201055983 | Y | 5/2008 |
| CN | 201592413 | U | 9/2010 |
| CN | 101890688 | A | 11/2010 |
| CN | 102114623 | A | 7/2011 |
| CN | 201960511 | U | 9/2011 |
| CN | 201960512 | U | 9/2011 |

* cited by examiner

SCREWDRIVER

BACKGROUND

1. Field of the Disclosure

The present disclosure relates to hand tools and more particularly, to a screwdriver which has a driver bit holder like a revolving wheel-shaped clip, for placing multiple driver bits of various forms. Driver bit holder can be rotated like rotating a clip to choose driver bits of different forms in operation.

2. Discussion of the Background Art

The screwdriver of prior art mostly has its driver rod extended forward from the handle, and the front end of the driver rod forms a driver bit or places a driver bit. When needing to use different forms of driver bits for work, the user has to replace the screwdriver or replace the driver bit, which is inconvenient. Each of U.S. Pat. No. 6,134,995A, U.S. Pat. No. 6,138,537A and U.S. Pat. No. 7,028,593B1 claims to protect a screwdriver. They all have driver bit holder similar to revolving wheel-shaped clip, for placing multiple driver bits of different forms. The driver bit holder can be rotated like rotating a clip when in use, to change driver bits of different forms. But the defects reside therein that:

1. Complicated structure;

2. The handle needs to be detached from the mounting position of the driver bit holder when the driver bit of the driver bit holder is to be replaced, which is inconvenient to operate;

3. When screwing, the handle is used to apply forward force to tightly push the pushrod so as to apply torque to screws, and the pushrod can easily retract;

4. The applied torque is restricted by the mating structure of the handle and the mounting position of the driver bit holder. As the mating structure is generally plastic, the torque is therefore limited;

5. The position that the driver bit holder and the pushrod coincides is shielded, which will shield the view of a user to hamper replacing the driver bit accurately;

6. Inconvenient to replace the driver bit holder, therefore inconvenient to replace the driver bit on the driver bit holder either;

7. Lacking positioning of the driver bit holder, the pushrod cannot accurately coincide with the driver bit mounting hole on the driver bit holder, so the driver bit cannot be smoothly pushed out;

8. As the effect of the driver bit is to apply torque to a screw, and the body of the driver bit is mostly hexagonal prism, so the shape of the inner hole of the driver bit sleeve that it mates should be fit with the shape of the driver bit. Further, in order to smoothly push out the driver bit, the hole (e.g. the containing hole on the driver bit holder, the inner hole of the driver bit sleeve and so on) that is used to contain driver bit mates the driver bit with gaps. So during the process of pushing the driver bit out, the front end of the driver bit (especially as shown in FIG. 33 the '–' shaped front end of the driver bit, the maximum size of the front end identical to that of the driver bit) will deviate from the inner hole of the driver bit sleeve so as to be hard to be pushed in; further, when the surface of the driver bit body deviates by a certain angle from the inner hole of the driver bit sleeve, it is also hard to push the driver bit into the inner hole of the driver bit sleeve; the scenarios above that the driver bit cannot be pushed into the inner hole of the driver bit sleeve will cause the screwdriver unusable.

Accordingly, it is an object of technicians in this field providing a screwdriver which is simple-structured, convenient to use, and can smoothly push out the driver bit.

SUMMARY

It is a technical object of the present disclosure to provide a screwdriver which is simple-structured, convenient to use, and can smoothly push out driver bit.

Following technical schemes are adopted by the present disclosure for smoothly pushing out the driver bit: driver bit sleeve is included, wherein inner hole of the driver bit sleeve includes torque transmission segment located in front part and first guiding segment located in rear part, and hole wall of the first guiding segment is arranged as a guiding surface.

Further, guiding surface can be a conical surface which defines the first guiding segment into a conical hole segment, and the diameter of rear end of the conical hole segment is larger than that of front end thereof.

Further, inner hole of the driver bit sleeve includes transition surface which is located between the torque transmission segment and the first guiding segment, and connects the torque transmission segment and the first guiding segment.

Further, the screwdriver in accordance with the present disclosure also includes revolving wheel-shaped driver bit holder. The revolving wheel-shaped screwdriver bit holder is rotatably arranged at rear side of the driver bit sleeve, and on the revolving wheel-shaped driver bit holder is distributed axial containing hole which contains driver bit, and the containing hole can rotate to axially coincide with inner hole of the driver bit sleeve. Further, front end of the containing hole is arranged with flaring.

Further, front end of the driver bit holder is arranged with ratchet structure; the driver bit sleeve is arranged on the ratchet structure; through hole which is co-axial with inner hole of the driver bit sleeve is arranged on the ratchet structure, and the containing hole can rotate to axially coincide with the through hole and inner hole of the driver bit sleeve. Further, front end of the through hole is arranged with flaring. Rear end of the through hole is arranged as second guiding segment. The second guiding segment can be a conical hole segment.

Further, the screwdriver also includes pushrod which can slide from a first position to a second position, when the pushrod is at the second position, the pushrod is located at rear side of the revolving wheel-shaped driver bit holder and axially coincides with inner hole of the driver bit sleeve.

In order to actualize the present disclosure to be simple-structured and convenient to use, following technical schemes are further adopted:

A screwdriver, which includes: handle, the front end of which is arranged with the driver bit sleeve, slit which is arranged extending forward and backward is provided at a position located at the rear of the driver bit sleeve on the handle, mounting position which is visible through the slit, slideway which is arranged at the edge of the slit, with first positioning portion arranged at the front part of the slideway; revolving wheel-shaped driver bit holder, whose the axial direction is along the same front-rear direction as that of the handle and is rotatably mounted at the mounting position; the revolving wheel-shaped driver bit holder has containing holes distributed thereon which contain driver bits axially, and the containing holes can rotate to axially coincide with inner hole of the driver bit sleeve; pushrod, which is provided in the handle along the front-rear direction and axially coincides with inner hole of the driver bit sleeve;

pushbutton set, which is assembled with the pushrod and slidably mates on the slideway, and can be positioned at the first positioning portion; when pushbutton set is positioned at the first positioning portion, the pushrod gets into one of containing holes of the driver bit holder, pushing a driver bit in the containing hole toward the driver bit sleeve until the driver bit extends out of the driver bit sleeve; when the pushbutton set is positioned at the rear part of the slideway, the pushrod is positioned at rear side of the driver bit holder.

As a preferred technical means of configuring driver bit sleeve at front end of handle, front end of the handle is arranged with ratchet structure; the driver bit sleeve is arranged on the ratchet structure; through hole which is co-axial with inner hole of the driver bit sleeve is arranged on the ratchet structure; the containing hole can rotate to axially coincide with the through hole and inner hole of the driver bit sleeve.

Specifically, the ratchet structure includes pawl seat, ratchet sleeve and rotary sleeve:

The pawl seat is fixed at the front end of the handle; the pawl seat is arranged with two opposite swingable pawls and a thumb piece for controlling the position status of two pawls, the thumb piece has two thumb nubble corresponding to the two pawls, respectively;

the ratchet sleeve is set on the pawl seat for gearing with the pawl;

the rotary sleeve is set at the outside of the pawl seat and connects thumb piece;

the driver bit sleeve is arranged on the ratchet sleeve, and the through hole is provided on the pawl seat.

Further, inner wall of the rotary sleeve has three positioning recesses; the pawl seat is arranged with positioning pin tumbler thereon; the positioning pin tumbler is supported by elastic element and located in a positioning recess. Two pawls have elastic element supporting in between, which keeps the two pawls open and leaning toward the ratchet sleeve.

As a preferred technical means of configuring driver bit sleeve at the front end of the handle wherein front end of the handle is arranged with a structural member, the driver bit sleeve is arranged on the structural member.

In order to provide slideway with wear resistance and sufficient strength, the slideway is metallic piece.

As a preferred technical means of first positioning portion, the first positioning portion is a gap arranged on the slideway. Then, a preferred technical means to actualize the positioning of pushbutton set at first positioning is: tail part of the pushrod extends toward the direction of the slideway and out of base portion; the pushbutton set includes locking plate, touch button and elastic element; the locking plate is moveably provided at the base portion along the direction, along which the base portion extends, within the moveable area where the locking plate can snap into the gap and detach from the gap; the elastic element is positioned between the locking plate and the base portion, pressing the locking plate toward inside of the gap with elastic force; the touch button is assembled on the base portion, slidable in front-rear direction, and is arranged thereon with touch portion which forces the locking plate to act. An alternate preferred technical means of actualizing the positioning of pushbutton set at first positioning portion is: tail part of the pushrod extends toward the direction of the slideway and out of base portion; the pushbutton set includes touch button and elastic element; the touch button is arranged with locking stop flange thereon; the touch button is moveably provided at the base portion along the direction, along which the base portion extends; within the moveable area of the touch button, where the locking stop flange can snap into the gap and detach from the gap; the elastic element is positioned between the touch button and the base portion, pressing the locking stop flange toward inside of the gap with elastic force. Further, supporting portion which supports the pushrod is arranged in the handle along the direction, along which the slideway extends.

In order to actualize the positioning of pushbutton set, rear part of the slideway is arranged with second positioning portion for positioning the pushbutton set. Specifically, the structure of the second positioning portion can be identical to the structure of the first positioning portion; the pushrod is positioned at the rear side of the driver bit holder when the pushbutton set is positioned at the second positioning portion.

In order to actualize the rotation of driver bit on handle and facilitate mounting and releasing, front wall of the mounting position and front end of the driver bit holder, and rear wall of the mounting position and rear end of the driver bit holder, are arranged with pit and telescopic shaft heard, respectively; elastic element is supported at the rear end of the telescopic shaft head and the telescopic shaft head is located in corresponding pit to actualize the mounting of the driver bit holder at the mounting position.

In order to actualize the positioning of driver bit holder on handle for the pushrod coinciding with the containing hole of the driver bit holder accurately, front wall or/and the rear wall of the mounting position, and the front end or/and the rear end of the driver bit holder are arranged with positioning pin tumbler and positioning recess, respectively, elastic element is supported at the rear end of the positioning pin tumbler; the positioning pin tumbler is located in the positioning recess to actualize the positioning of the driver bit holder on the handle.

In order to prevent driver bit in containing hole from detachment, the inner wall of the containing core has elastic structure.

In order to recognize the form of driver bit in containing hole, the driver bit holder has driver bit sign on positions that correspond to each containing hole. Or the driver bit holder is made transparent.

In order to backup more driver bits, the handle is arranged with containing portion hereon for storing backup driver bit holder. Or the handle is arranged with backup driver bit storage holder thereon.

In order to facilitate gripping and applying pushing force on pushrod, the handle has gripping portion extending toward the side of the pushrod.

As a preferred technical means of mating front end of pushrod and driver bit, the front end of the pushrod or/and the driver bit are arranged with engagement structures thereon for the engagement of the both; the pushrod is located at the rear side of the driver bit holder when the pushbutton set is located at the rear part of the slideway, and brings the corresponding driver bit back into corresponding containing hole relying on the engagement structures. Specifically, the engagement structures are magnetic structures provided for both of front end of the pushrod or/and the driver bit to adhere to. The engagement structures can also be tenon and mortise arranged at front end of the pushrod and rear end of the driver bit respectively.

As a preferred technical means of preventing driver bit from interfering the rotation of driver bit holder, rear end of the containing hole has a blocking portion. Or a slit gap is arranged between rear end of the driver bit holder and rear wall of the mounting position; front end of the pushrod coincides with the slit gap when the pushbutton set is located at rear part of the slideway.

The handle of the present disclosure can be a revolver type handle or a straight handle.

The advantageous effects of the present disclosure are:

1. Fewer constituent components, simple-structured;

2. To replace driver bit from driver bit holder, just need to rotate driver bit holder and push the pushrod to move forward and backward, no need to separate driver bit holder from the handle, which is convenient to use;

3. When screwing, pushrod is positioned on the slideway of the handle through pushbutton set, and the pushrod cannot easily retract; the applied torque are born by driver bit sleeve, and the torque can be large;

4. The driver bit holder mounted at the mounting position is visible through the slit on the handle, so that the driver bit required can be accurately rotated to coincide with pushrod and further be pushed out by pushrod;

5. The driver bit holder is assembled at mounting position through the form of mating of the telescopic shaft and the pit, which is convenient for mounting and demounting;

6. The driver bit holder can be positioned on the handle through the form of mating of the telescopic positioning pin tumbler and positioning recess, which ensures that some containing hole on the driver bit holder coincides with the pushrod so that the pushrod smoothly pushes the driver bit in the containing hole out.

7. By the arrangement of guiding segment on the inner hole of the driver bit sleeve, pushing out driver bit will not be obstructed and the driver bit can smoothly enter the inner hole of the driver bit sleeve to reach work position; when the surface of the driver bit body deviates by a certain angle with respect to the inner hole of the driver bit sleeve, the surface of the driver bit body can be turned to coincide with the surface of inner hole of the driver bit sleeve by turning the driver bit by a certain angle through the guiding surface, so as to smoothly enter the inner hole of the driver bit sleeve to reach work position.

8. By arranging a flaring at the front end of the containing hole on the driver bit holder, the driver bit can smoothly enter the containing hole on the driver bit holder when the driver bit is retracted.

Hereinafter more detailed description will be made by incorporating figures to illustrate the conception, structure and technical effect of the present disclosure for a better understanding of the object, features and effects of the present disclosure.

DESCRIPTION OF THE REFERENCE NUMERALS IN THE FIGURE

1—handle, 11—driver bit sleeve, 11*a*—torque transmission segment, 11*b*—first guiding segment, 11*c*—guiding surface, 11*d*—transition surface, 11*e*—inner hole angle of driver bit sleeve, 12—slit, 13—mounting position, 14—slideway, 14*a*—first positioning portion, 15—ratchet structure, 15*a*—through hole, 15*a*1—flaring, 15*a*2—second guiding segment, 15*b*—pawl seat, 15*c*—ratchet sleeve, 15*d*—rotary sleeve, 15*e*—pawl, 15*f*—thumb piece, 15*g*—thrumb nubble, 15*h*—positioning recess, 15*i*—positioning pin tumbler, 16—slideway, 17—shoulder, 18—pit, 19—positioning pin tumbler, 110—containing portion, 111—gripping portion, 112—gripping portion;

2—driver bit holder, 21—driver bit, 21*a*—arris of driver bit body, 22—containing hole, 22*a*—flaring, 23—blocking portion, 24—telescopic shaft head, 25—positioning recess, 26—elastic structure, 27—driver bit sign, n-n—axial direction of driver bit holder;

3—pushrod, 31, 32—base portion;

4—pushbutton set, 41—locking plate, 42—touch button, 43—touch portion, 44—touch button, 45—locking stop flange;

5—backup driver bit holder;

6—backup driver bit storage holder.

DETAILED DESCRIPTION OF THE PREFERRED EMBODIMENTS

The present disclosure will described upon the following preferred embodiments taken in connection with the accompanying drawings. The 'front' used herein is to describe the portion where a component is close to the driver bit sleeve 11, i.e. the right side in FIG. 1; and the 'rear' used is to describe the opposite portion of the component to what 'front' refers to, i.e. to the left side in FIG. 1.

Figure 1:
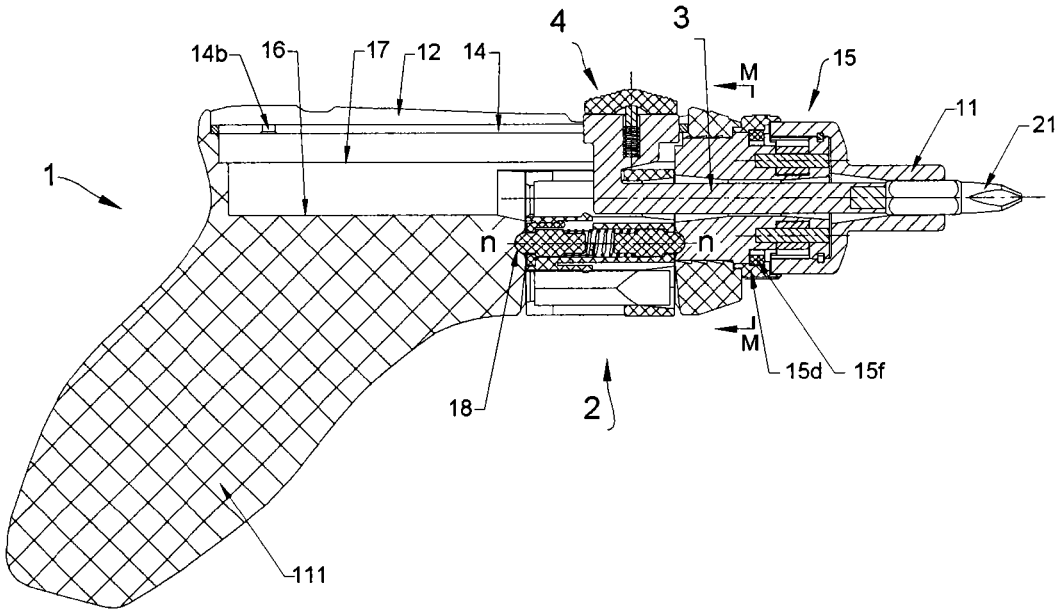
FIG. 1 is a sectional structural schematic view of a preferred embodiment of the screwdriver with a driver bit which can be smoothly pushed out in accordance with the present disclosure.
Figure 5:
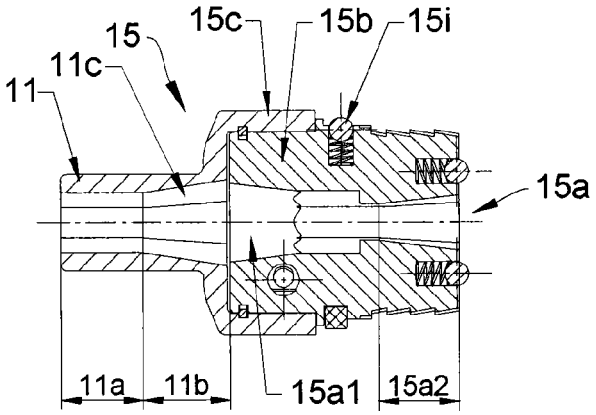
FIG. 5 is a sectional view of the structure taken along line B-B of FIG. 3.
Figure 6:
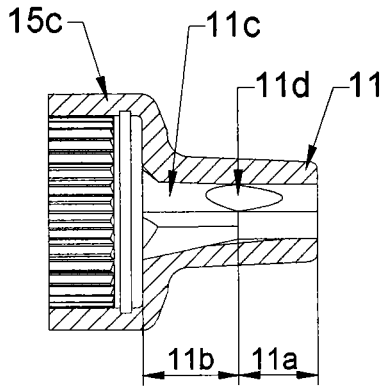
FIG. 6 is a schematic view of the structure of FIG. 5 showing the ratchet sleeve and the arrangement of the driver bit sleeve on the ratchet sleeve.
Figure 7:
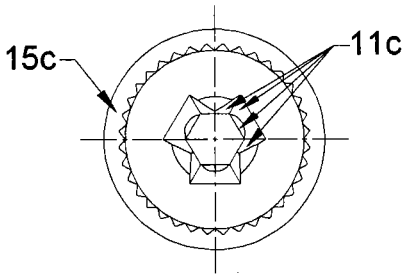
FIG. 7 is a left view of FIG. 6.
Figure 22:
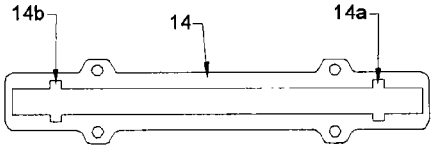
FIG. 22 is a schematic view of the structure of FIG. 1 showing the slideway.
Figure 29:
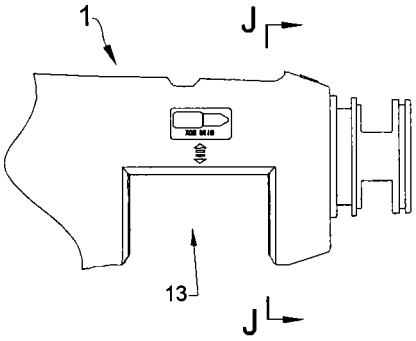
FIG. 29 is a schematic view of the structure of FIG. 1 showing the handle with the pawl seat assembled thereon.
Figure 30:
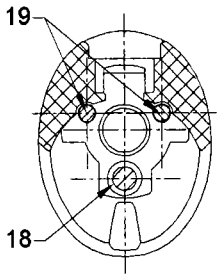
FIG. 30 is a sectional view taken along line J-J of FIG. 29.

FIG. 1 shows a preferred embodiment of a cross sectional structure of the screwdriver in accordance with the present disclosure, the screwdriver including:

handle 1, the front end of which is arranged with driver bit sleeve 11; slit 12 arranged extending forward and backward is provided at the position located at the rear of driver bit sleeve 11 on handle 1 and mounting position 13 is visible through slit 12 (seen in FIG. 29); slideway 14 is arranged at the edge of slit 12; first positioning portion 14*a* is arranged at the front part of slideway 14 (seen in FIG. 22); further, referring to FIG. 5-7, inner hole of driver bit sleeve 11 includes torque transmission segment 11*a* located in front part and first guiding segment 11*b* located in rear part; hole wall of first guiding segment 11*b* is arranged as guiding surface 11*c*; specifically, guiding surface can be a conical surface which defines first guiding segment 11*b* into a conical hole segment; the diameter of rear end (right end shown in FIG. 5) of conical hole segment is larger than that of front end (left end shown in FIG. 6) thereof; in order to further cause driver bit enter driver bit sleeve smoothly, inner hole of driver bit sleeve includes transition surface 11*d* which is located between torque transmission segment 11*a* and first guiding segment 11*b*, and which connects torque transmission segment and first guiding segment; transition surface 11*d* causes substantially smooth transition between torque transmission segment 11*a* and first guiding segment 11*b* without apparent sharp edges.

Revolving wheel-shaped driver bit holder 2 (seen in FIG. 8-16), rotary shaft along axial direction n-n thereof (i.e. the direction of the axis thereof, seen in FIG. 1, FIG. 13 and FIG. 15-16) is of the same front-rear direction as that of handle (the front-rear direction of handle is determined to be the same as the extending direction of slit 12, slideway 14 and pushrod 3 to be referred hereinafter), and is rotatably mounted at mounting position 13; axial containing holes 22 which contains driver bit 21 are distributed around thereon and containing holes 22 can rotate to axially coincide with inner hole of driver bit sleeve 11; further, as showing in FIG. 10, front end (right end shown in the figure) of containing hole 22 is arrange with flaring 22*a*, so that driver bit is not blocked when driver bit retracts, to cause driver bit retract into containing hole 22 smoothly.

Pushrod 3 (seen in FIG. 23, FIG. 26), which is disposed in handle 1 along the front-rear direction and axially coincides with inner hole of driver bit sleeve 11, can slide from first position to second position.

Pushbutton set 4 (seen in FIG. 24, FIG. 25, FIG. 27 and FIG. 28) is assembled with pushrod 3 and slidably mates on slideway 14, and can be positioned at first positioning portion 14*a*.

When pushbutton set 4 is positioned at first positioning portion 14*a*, pushrod 3 is at first position, getting into one of containing holes of driver bit holder 2 to push the driver bit which is inside containing hole toward driver bit sleeve 11 until the driver bit extends out of driver bit sleeve 11; when pushbutton set 4 is positioned at rear part of slideway 14, pushrod 3 is positioned at rear side of driver bit holder 2.

The screwdriver depicted in foregoing FIG. 1 comprises fewer constituents, simple structured, and is convenient in use.

When using the screwdriver, one can grip handle 1 with a hand, and rotate driver bit holder 2 to turn the containing hole with a desired driver bit to correspond to pushrod 3, and then push forward pushrod 3 by pushbutton set 4; front end of pushrod 3 contacts driver bit in corresponding containing hole and engages driver bit, until pushbutton set 4 is positioned at first positioning portion 14*a*; then front end of pushrod 3 reaches into corresponding containing hole and pushes the driver bit therein toward driver bit sleeve 11 until driver bit extends out of driver bit sleeve 11 for screwing. As the cross-section of driver bit body is generally regular hexagon, the cross-section of inner hole of driver bit sleeve 11 should also be regular hexagon so as to correspond with driver bit for torque transmission; as pushbutton set 4 is positioned at first positioning portion 14*a*, pushrod 3 is unable to extend or retract, while one can apply pushing force on pushrod 3 via handle 1 to insert driver bit 21 into the slot on the top of the screw for then screwing. As guiding section is arranged in inner hole of driver bit sleeve, driver bit will not be obstructed when pushed out, and driver bit can smoothly enter inner hole of driver bit sleeve to reach work position; when arris 21*a* of driver bit body is caused to deviate from inner hole angle 11*e* of driver bit sleeve (seen in FIG. 35) for various reasons, driver bit can be turned by certain proper angle through the guiding surface to let arris 21*a* of driver bit body coincides with inner hole angle 11*e* of driver bit sleeve (seen in FIG. 34), so that driver bit is smoothly pushed into inner hole of driver bit sleeve to reach work position.

After use, pushbutton set 4 can be operated to release positioning from first positioning portion 14*a* and pull back the pushrod 3 along with to rear part of slideway 14 until pushrod 3 retracts from corresponding containing hole to second position at the rear side of driver bit holder 2, such that driver bit holder will not be obstructed to rotate, and driver bit in driver bit sleeve 11 can retract into the corresponding containing core of driver bit holder. As flaring is arranged at the front end of containing hole on driver bit holder, driver bit can smoothly enter into containing core on driver bit holder when driver bit is retracted.

The screwdriver can be easily operated when in use, by rotating driver bit holder and manipulation of pushbutton set to push or pull back pushrod. And as it is assembled with driver bit hole of revolving wheel-shaped clip style such as that on a revolver, and it can be rotated like a clip in use to rotate driver bit holder to choose different forms of driver bit which is pushed forward like a bullet, thus the present disclosure can be named as 'Revolver Screwdriver'.

In use, when screwing, pushrod is positioned on slideway of handle by pushbutton set and pushrod is not easily retracted; driver bit sleeve bears the applied torque and the bearable torque is larger; driver bit holder assembled at mounting position is visible through slit on handle, so driver bit required for use can be accurately rotated to correspond with pushrod and further be pushed out by the pushrod.

At this point, the above-described structure of the embodiment illustrates the inventive concept of the present disclosure as well as to the technical features to achieve the present disclosure. However, as the further improvement and complement of the above technical solution, the embodiment further comprises the following technical means, so that during the embodiment of the present disclosure, they are selected on the technical solution of the previous paragraph according to the specific role.

Figure 2:
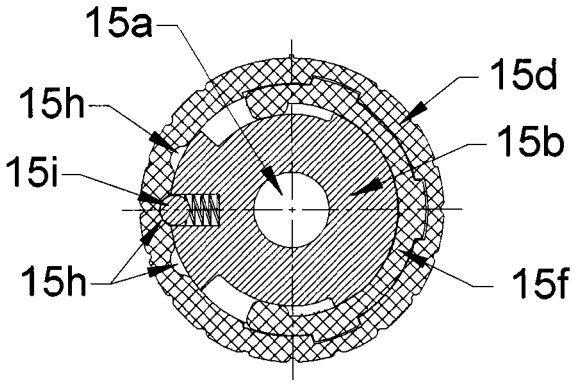
FIG. 2 is a sectional view along the direction of M-M of FIG. 1, showing the positioning of the rotary sleeve 15*d* on the pawl seat 15*b;*
Figure 3:
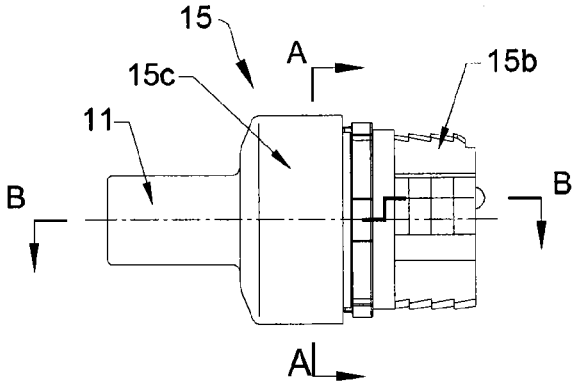
FIG. 3 is a schematic view of the structure of FIG. 1 showing the ratchet structure and the arrangement of the driver bit sleeve on the ratchet structure.
Figure 4:
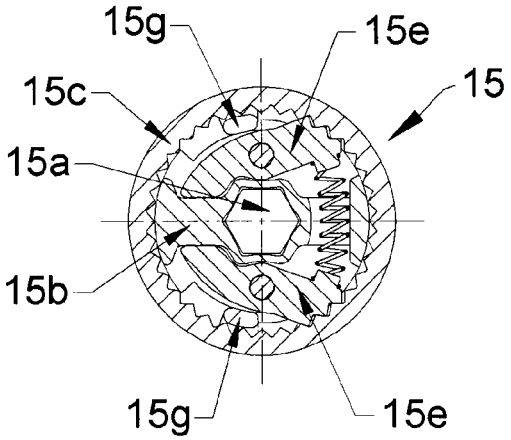
FIG. 4 is a sectional view of the structure taken along line A-A of FIG. 3.

First, as a preferred technical means of the preferred embodiment in configuring driver bit sleeve 11 at front end of handle 1, see FIGS. 3-7 and FIGS. 17-21, ratchet structure 15 is arranged at front end of handle 1; the driver bit sleeve 11 is arranged on ratchet structure 15; through hole is arranged on ratchet structure 15 for connecting driver bit sleeve 11 to containing hole of driver bit holder. Ratchet structure 15 can be made of metallic material to ensure strength. Therefore, the directional rotation (clockwise rotational torque is applied or counterclockwise rotational torque is applied) of driver bit sleeve 11 and inner driver bit therein can be achieved through the ratchet structure 15 to provide convenience for use. Specifically, ratchet structure 15 includes pawl seat 15*b*, ratchet sleeve 15*c* and rotary sleeve 15*d*: pawl seat 15*b* is fixed at front end of handle 1 and formed into an integrity with the handle; pawl seat 15*b* is arranged with two opposite swingable pawls 15*e* and thumb piece 15*f* for controlling the position status of the two pawl; thumb piece 15*f* has two thumb nubble 15*g* corresponding to pawl 15*e*, respectively; ratchet sleeve 15*c* is set on the pawl seat 15*b* for gearing with pawl 15*e*; rotary sleeve 15*d* is set at the outside of pawl seat 15*b* and connects thumb piece 15*f*; driver bit sleeve 11 is arranged on the ratchet sleeve 15*b*; through hole 15*a* is provided on pawl seat 15*b*. Through the structural form of arranging driver bit sleeve on ratchet structure, driver bit 21 is pushed into driver bit sleeve 11 from containing hole of driver bit holder via the through hole 15*a*, or pulled back from driver bit sleeve via a through hole to containing hole of driver bit holder. The ratchet structure, when rotary sleeve 15*d* is rotated, drive by two thumb nubble 15*g* of thumb piece 15*f* to change the position state of two pawl 15*e*, and then change the meshing relationship (i.e. shift) between two pawls and the ratchets in ratchet sleeve 15*c* to meet the work demands: as the state shown in FIG. 4, where two pawl 15*e* simultaneously mesh with the internal ratchets in ratchet sleeve 15*c*, thus, regardless of if handle rotates clockwise or counterclockwise, the torque from handle can be transmitted to driver bit sleeve 11 via pawl seat 15*b*, wherein one of the pawls and ratchet sleeve 15*c* transmitted to driver bit sleeve 11 to cause driver bit apply forces on screws. When two thumb nubbles 15*g* is rotated clockwise by an angle through a rotary sleeve 15*d* from the status shown in FIG. 4, one of the pawls (the top one shown in the figure) is pushed away from ratchet sleeve 15*c* and another pawl (the lower one shown in figure) continues to mesh with internal ratchets in ratchet sleeve 15*c*. At this point, the counterclockwise rotation of the handle can transmit the torque from handle to driver pit via pawl seat 15*b*, pawl meshing with ratchet sleeve, ratchet sleeve 15*c* and driver bit sleeve 11; the clockwise rotation of handle, otherwise, pawls meshing with ratchet sleeve can be driven by pawl seat to slide over the ratchets of ratchet sleeve without transmitting torque to driver rod, so as to let handle turn. When rotate counterclockwise two thumb nubble 15*g* through rotary sleeve from the status shown in FIG. 4, one of the pawls (the lower one shown in the figure) is pushed away from ratchet sleeve and the other pawl (the top one shown in the figure) continues to mesh with the internal ratchets of ratchet sleeve; at this point, clockwise rotation of handle can transmit the torque from handle to driver bit through pawl seat 15*b*, pawl meshing with ratchet sleeve, ratchet sleeve 15*c* and driver bit sleeve 11; while counterclockwise rotation of handle, pawls meshing with ratchet sleeve are driven by pawl seat to slide over ratchets of ratchet sleeve without transmitting torque to driver rod, so as to let handle turn. Further, referring to FIG. 2, the inner wall of rotary sleeve 15*d* has three positioning recess 15*h*; pawl seat 15*b* is arranged with positioning pin tumbler 15*i* thereon; the positioning pin tumbler 15*i* is supported by elastic element and located in positioning recess, such that rotary sleeve 15*d* can be circumferentially positioned. Therefore, no matter which one of the above-mentioned three work positions the rotary sleeve turns to, it is held in the position through positioning. Two pawls 15*e* have an elastic element supported in between which keeps them open and leaning toward the ratchet sleeve. The meshing of pawl with ratchet sleeve is thus ensured. The use of an elastic element is for supporting two pawls with fewer parts and compact structure.

Figure 34:
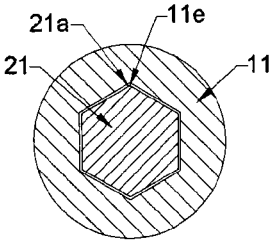
FIG. 34 is a cross sectional view thereof when the arris of the drive bit body coincides with the inner hole angle of the driver bit sleeve.
Figure 35:
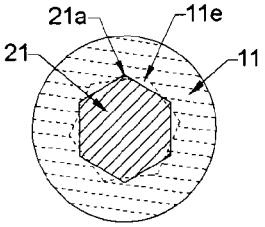
FIG. 35 is a cross sectional view thereof when the arris of the drive bit body deviates from the inner hole angle of the driver bit sleeve.

As a preferred technical means of the preferred embodiment, based on the arrangement of ratchet structure, as shown in FIG. 5, front end (left end shown in figure) of through hole 15*a* is arranged with flaring 15*a*1; the rear end (right end shown in figure) of through hole 15*a* is arranged as second guiding segment 15*a*2; second guiding segment can be conical hole, so that driver bit can be smoothly pushed out when passing through the through hole and be smoothly retracted. According to the segment when front end of handle 1 is arranged with ratchet structure 15 and driver bit sleeve 11 is arranged on ratchet structure 15, as larger number (generally more than 6, such as 18-36) of internal ratchet on ratchet sleeve 15*c*, when pawl randomly slides over the internal ratchet (the case when in actual use), phenomenon that arris 21*a* of driver bit body deviates from inner hole angle 11*e* of driver bit sleeve will be caused as showing in FIG. 35, which is bound to obstruct driver bit from being pushed into inner hole of driver bit sleeve; and in accordance with the embodiment of the present disclosure when inner hole of driver bit sleeve 11 is designed with first guiding segment 11*b*, during the process of driver bit being pushed toward inner hole of driver bit sleeve 11, driver bit can be rotated for a certain proper angle as shown in FIG. 34 through the guiding effect of the first guiding segment 11*b*, to cause arris 21*a* of driver bit body coincides with inner hole angle 11*e* of driver bit sleeve, so that driver bit can be smoothly pushed into inner hole of driver bit sleeve to reach work position.

Secondly, as another preferred technical means of the preferred embodiment arranging driver bit sleeve 11 at front end of the handle, structural member is arranged at front end of handle 1; driver bit sleeve is arranged on the structural member. If pawl seat of the ratchet structure is regarded as structural member, driver bit sleeve can just be processed out from pawl seat; or using ratchet sleeve of the ratchet structure with driver bit sleeve as structural member, ratchet sleeve can just be arranged at front end of handle. The object of arranging structural member at front end of handle is to increase the strength of driver bit sleeve to facilitate manufacturing. If the handle itself is strong enough for the arrangement of driver bit sleeve to transmit torque to driver bit and suitable processing method is available, driver bit sleeve can be directly processed out from front end of handle as an equivalent technical means.

The slideway 14 (seen in FIG. 22) is a metallic piece and assembled on handle in accordance with the preferred embodiment in order to make slideway 14 wear resistant and possess enough strength.

As a preferred technical means of the preferred embodiment of first positioning portion, first positioning portion 14*a* is a gap (seen in FIG. 22) arranged on the slideway 14.

Figure 23:
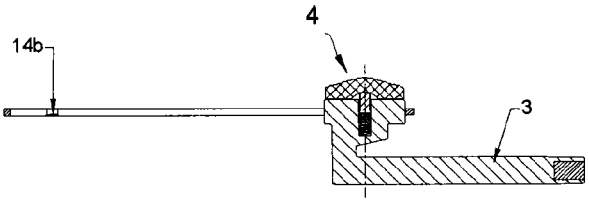
FIG. 23 is an assembly schematic view of the structure of FIG. 1 showing the pushrod, pushbutton set and slideway.
Figure 24:
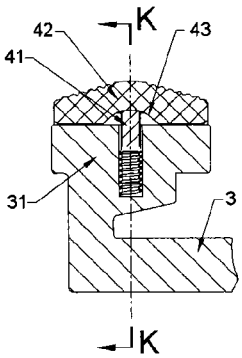
FIG. 24 is an enlarged schematic view of the assembled structure of FIG. 23 showing the pushrod, pushbutton set and slideway.
Figure 25:
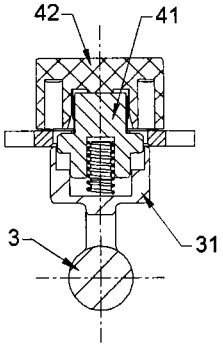
FIG. 25 is a sectional view taken along line K-K of FIG. 24.

When first positioning portion 14*a* is a gap arranged on the slideway, a preferred technical means to actualize the positioning of pushbutton set 4 at first positioning portion 14*a* is: seen in FIG. 23-25, tail part of pushrod 3 extends toward the direction of slideway and out of base portion 31; pushbutton set 4 includes locking plate 41, touch button 42 and elastic element. Locking plate 41 is moveably provided at base portion 31 along the direction along which base portion 31 extends and can snapped into and detach out from the gap within the moveable area thereof. Elastic element positioned between locking plate 41 and base portion 31 presses locking plate 41 toward inside of the gap with elastic force. Touch button 42 is slidably assembled on base portion 31 in front-rear direction and arranged with touch portion 43 thereon which forces locking plate to move. As shown in figure, the touch portion is circular arc surface with both short ends and high middle (also can be an inclined surface with both short ends and high middle). In such a structure, when locking plate 41, as showing in figure, is snapped in the gap to actualize the positioning of pushbutton set 4 on slideway 14, touch button 42 is pulled back by hand to cause locking plate 41 detach from the gap by way of pressingly hold locking plate 41 to conquer the elastic force of elastic element, to actualize to release the locking of pushbutton set 4 on slideway 14, and pushbutton set 4 is pulled back along with on slideway 14; when pushbutton set 4 is pulled to the gap as second positioning portion 14*b* to be hereinafter described, locking plate 41 is flipped into the gap, by the effect elastic element, to actualize the positioning of pushbutton set 4. On the other hand, the movement of pushbutton set 4 when touch button 42 is pushed forward from the gap acting as second positioning portion 14*b*, is the same as that thereof when touch button is pulled back from the gap acting as first positioning portion, which is not intended to be repeated again herein.

Figure 26:
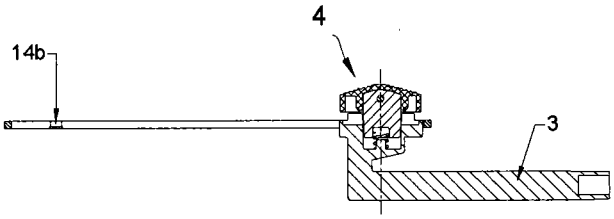
FIG. 26 is an alternative assembly schematic view of the assembled structure of FIG. 23 showing alternative pushrod, pushbutton set and slideway.
Figure 27:
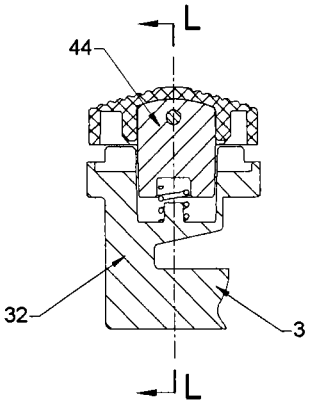
FIG. 27 is an enlarged schematic view of the assembled structure of FIG. 26 showing the pushrod, pushbutton set and slideway.
Figure 28:
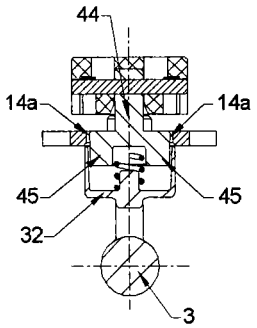
FIG. 28 is a sectional view taken along line L-L of FIG. 27.

When first positioning portion 14*a* is the gap arranged on slideway 14, an alternate preferred technical means to actualize pushbutton set 4 be positioned at first positioning portion 14*a* is: seen in FIG. 26-28, the tail part of pushrod 3 extends out of base portion 32 toward the direction of slideway 14; pushbutton set 4 includes touch button 44 and elastic element. Touch button 44 is arranged with locking stop flange 45 thereon and is moveably disposed at base portion 32 along the direction along which base portion extends and locking stop flange 45 can be snapped in or detached from the gap within the moveable range of touch button. Elastic element is positioned between touch button 44 and base portion 32, and flips locking stop flange 45 toward inside of the gap with elastic force. In such a structure, when locking stop flange 45 is snapped in the gap as shown in figure to actualize the positioning of pushbutton set 4 on slideway 14, touch button 44 is first pressed down to conquer the elastic force of elastic element to cause locking stop flange 45 be detached out from the gap to release the positioning of pushbutton set at the gap, and then touch button 44 is pulled back along with to pull back the pushrod. When pushbutton set 4 is pulled to the gap acting as second positioning portion 14*b* which is to be described below, touch button is released and touch button 44 is flipped up by the effect of elastic element to cause locking stop flange 45 be snapped into the gap to actualize the positioning of pushbutton set. On the other hand, when the gap acting as second positioning portion pushes forward touch button, the movement of pushbutton set is the same thereof when touch button is pulled back from the gap acting as first positioning portion, which is not intended to be repeated herein. Further (especially with respect to the latter technical means of actualizing the positioning of pushbutton set at first positioning portion, where touch button needs to be pressed down in operation), supporting portion which supports pushrod is arranged in handle along the direction along which slideway extends, so as to support the pushrod when touch button is pressed down. The reason why supporting portion is arranged along the direction along which slideway extends is because pushrod can thus smoothly move back and forth along supporting portion. When supporting portion is practically arranged, groove shaped slideway 16 can be arranged at the lower part of corresponding pushrod 3 of handle or shoulder 17 can be arranged at either sides of corresponding extending part 32 of handle. In this preferred embodiment, groove shaped slideway 16 and shoulder 17 exist simultaneously.

In order to actualize the positioning of pushbutton set 4 at the rear part of slideway 14, the rear part of slideway 14 is arranged with second positioning portion 14*b* for positioning pushbutton set. Specifically, the structure of the second positioning portion 14*b* can be identical to the structure of first positioning portion 14*a* (seen in FIG. 26). Pushrod 3 is positioned at the rear side of driver bit holder 2 when pushbutton set 4 is positioned at the second positioning portion 14*b*. Besides, as pushbutton set does not need to endure pushing force along front-rear direction (such as the pushing force required when screwing) when positioned at second positioning portion, so the structure of the second positioning portion can be a structure elastically mating the pushbutton set or magnetically attached structure etc., which is used for holding pushbutton set at the second positioning portion.

In order to actualize the rotation of driver bit holder 2 on handle 1 and facilitate mounting and removal, seen in FIG. 8-16, FIG. 29 and FIG. 30, front wall of mounting position 13 and front end of driver bit holder 2, and rear wall of mounting position 13 and rear end of driver bit holder 2, are arranged with pit 18 and telescopic shaft heard 24, respectively. Elastic element is supported at the rear end of telescopic shaft head 24 and telescopic shaft head is located in corresponding pit so as to actualize that driver bit holder 2 is mounted at mounting position 13 and can rotate. As shown in figure, telescopic shaft heads 24 are all mounted on driver bit holder 2, and pits 18 are located on front wall and rear wall of mounting position 13. In addition, if desired telescopic shaft head and pit can switch their positions.

In order to actualize the positioning of driver bit holder 2 on handle so that pushrod 3 can accurately coincide with the containing hole 22 of driver bit holder 2, seen in FIG. 8-16, FIG. 30, front wall or/and rear wall of mounting position 13, and front end or/and rear end of driver bit holder 2 are arranged with positioning pin tumbler 19 and positioning recess 25, respectively. Elastic element is supported at the rear end of positioning pin tumbler 19. Positioning pin tumbler 19 is located in positioning recess to actualize the positioning of driver bit holder on handle. As shown in figure, positioning pin tumbler 19 is located at front wall of mounting position 13 and positioning recess 25 is located at the front end edge of driver bit holder 2. In addition, the positioning structure can be arranged at the rear wall of mounting position and the edge of the rear end of driver bit holder or simultaneously arranged along with rear end as required. If the structure permits, positioning pin tumbler and positioning recess can also switch their positions.

Figure 9:
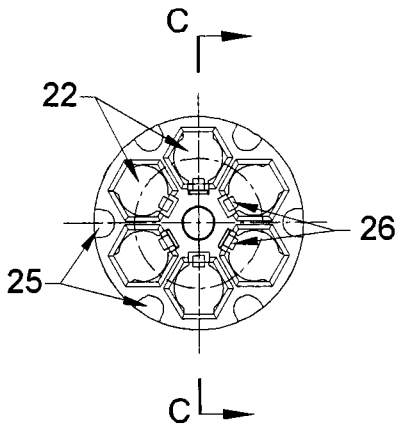
FIG. 9 is a left view of FIG. 8.
Figure 10:
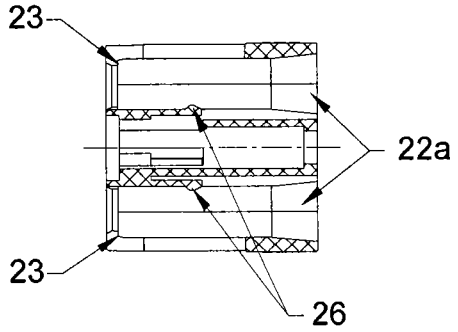
FIG. 10 is a sectional view taken along line C-C of FIG. 9.
Figure 11:
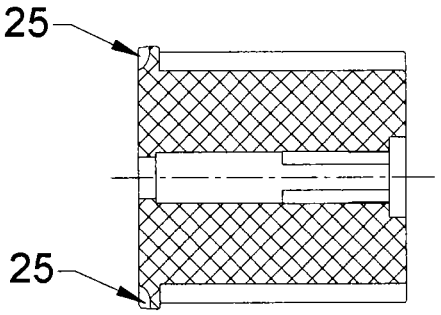
FIG. 11 is a sectional view taken along line D-D of FIG. 8.
Figure 12:
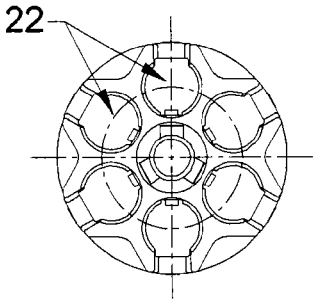
FIG. 12 is a right view of FIG. 8.
Figure 15:
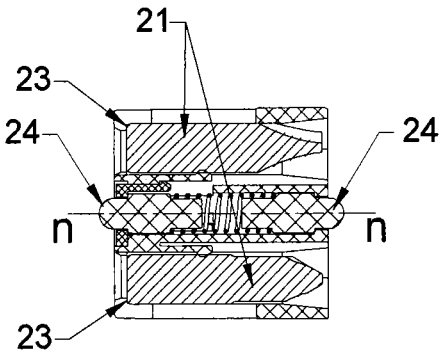
FIG. 15 is a sectional view taken along line E-E of FIG. 14.
Figure 16:
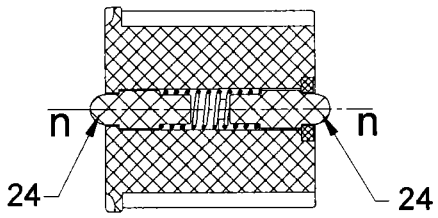
FIG. 16 is a sectional view taken along line F-F of FIG. 13.
Figure 17:
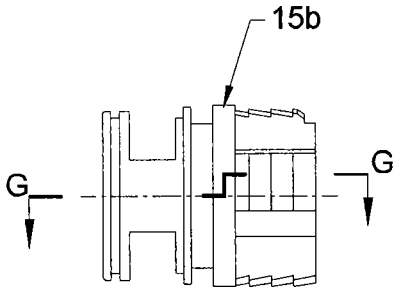
FIG. 17 is a schematic view of the structure of FIG. 1 showing the pawl seat.
Figure 18:
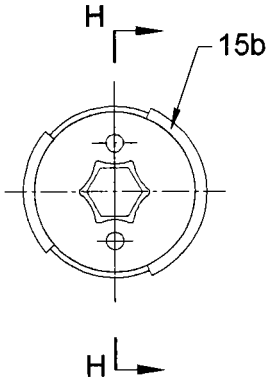
FIG. 18 is a left view of FIG. 17.
Figure 19:
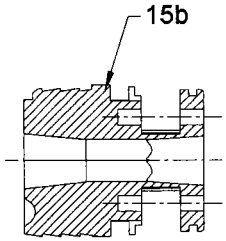
FIG. 19 is a sectional view taken along line H-H of FIG. 18.
Figure 20:
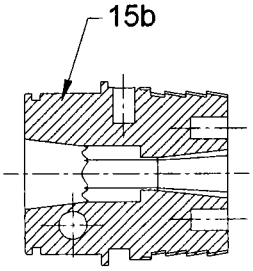
FIG. 20 is a sectional view taken along line G-G of FIG. 17.
Figure 21:
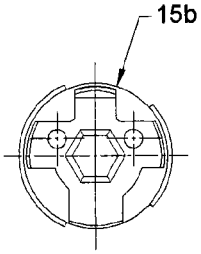
FIG. 21 is a right view of FIG. 17.

In order to prevent the driver bit 21 in containing hole 22 from detachment, inner wall of containing hole 22 has elastic structure 26, as shown in figure, which is a flip plate made on the inner wall of containing hole 22 (seen in FIG. 9-10, FIG. 15).

Figure 8:
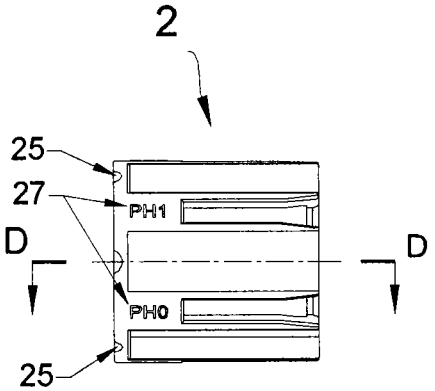
FIG. 8 is a schematic view of the structure of FIG. 1 showing the driver bit holder.
Figure 13:
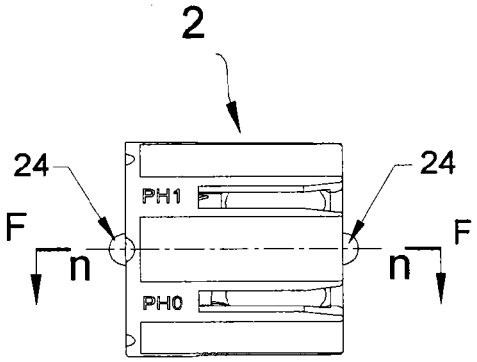
FIG. 13 is a schematic view of the structure of FIG. 1 showing the driver bit holder with the drive bit thereon.
Figure 14:
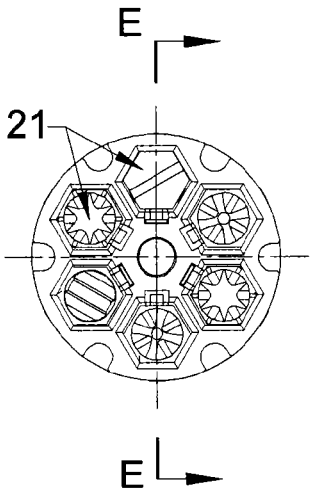
FIG. 14 is a left view of FIG. 13.

In order to facilitate recognizing the form of driver bit in containing hole, driver bit holder 2 has driver bit sign 27 on positions that correspond to each containing hole (seen in FIG. 8, FIG. 13). Or else the driver bit holder 2 is made transparent to facilitate recognizing the form of driver bit through driver bit holder.

Figure 31:
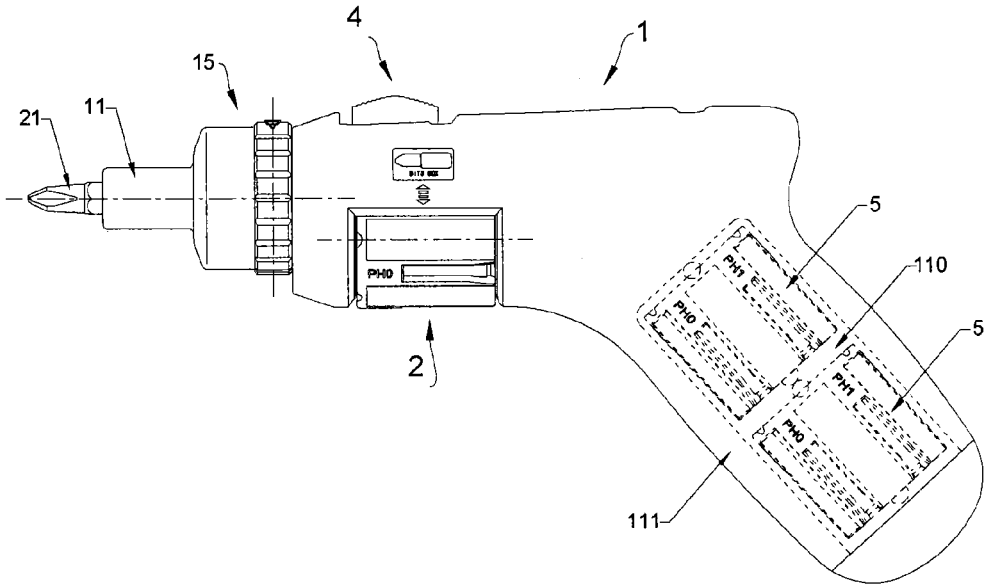
FIG. 31 is a schematic view of the handle arranged with the backup driver bit holder thereon.
Figure 32:
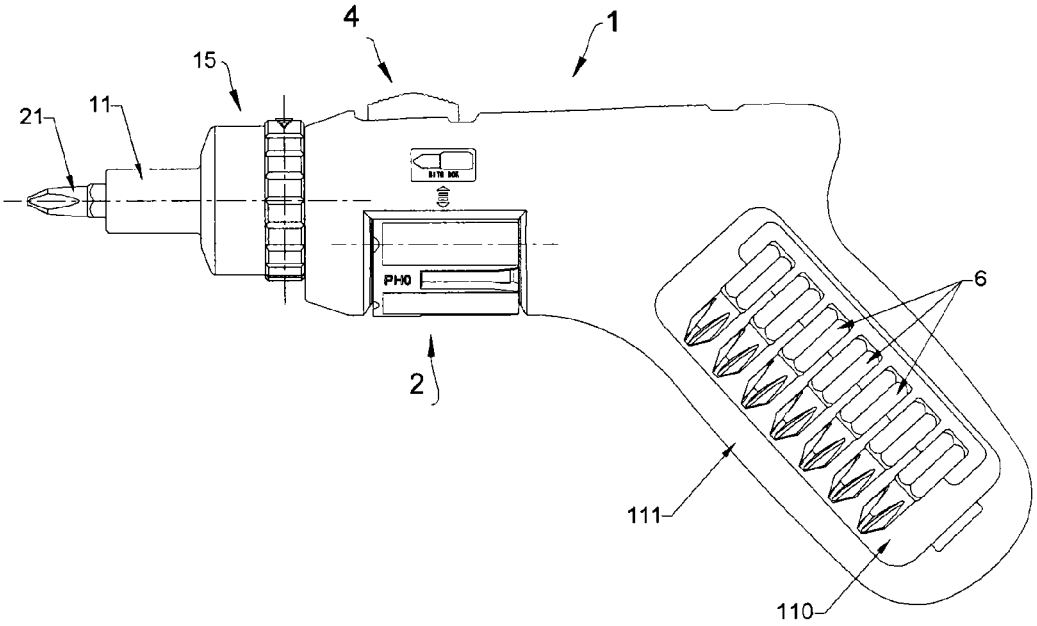
FIG. 32 is a schematic view of the handle arranged with backup driver bit thereon.
Figure 33:
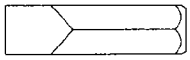
FIG. 33 is a schematic view of the '–' shaped driver bit.

In order to backup more driver bit, handle 1 is arranged with a containing portion 110 thereon (seen in FIG. 31-32) for storing backup driver bit holder 5; or handle 1 is arranged with backup driver bit storage holder 6 thereon.

In order to facilitate gripping and applying pushing force on pushrod, handle 1 has gripping portion 111 (seen in FIG. 1, FIG. 31 and FIG. 32) extending toward the side of pushrod 3; as shown in figure, such arranged gripping portion make the whole screwdriver, of which driver bit can be smoothly pushed out, look more like a revolver in shape.

As a preferred technical means of mating front end of pushrod and driver bit, front end of pushrod 3 or/and driver bit 21 are arranged with engagement structure thereon for the engagement of the both. Pushrod 3 is located at the rear side of driver bit holder 2 when pushbutton set 4 is located at the rear part of slideway 14, and brings the corresponding driver bit back into corresponding containing hole relying on the engagement structure. In light of the engagement structure, driver bit can be prevented from the detachment out of driver bit sleeve 11 relying on the engagement structure when pushrod 3 pushes driver bit into driver bit sleeve 11. The pull-back process of pushrod can also rely on the engagement structure to bring corresponding driver bit back into corresponding containing hole. Specifically, the engagement structure can be magnetic structure provided for both of front end of pushrod or/and driver bit to adhere to. Generally, as driver bit is mostly a standard piece and nonmagnetic, front end of pushrod is then made magnetic (such as by putting permanent magnetic therein) to actualize magnetic engagement thereof with driver bit. The engagement structure can also be tenon and mortise (such as the engaged tenon 40 and mortise 144 as described in U.S. Pat. No. 6,138,537, arranged at rear end of driver bit and front end of pushrod, respectively) arranged at front end of pushrod and rear end of driver bit.

As a preferred technical means of preventing driver bit from interfering the rotation of driver bit holder, the rear end of containing hole has blocking portion 23. When driver bit is pulled back relying on any of abovementioned engagement structure, driver bit is stopped by blocking portion 23 (such as shoulder) at rear end of containing hole from detaching from front end of pushrod 3 and is kept in containing hole so as not to be exposed outside to interfere the rotation of driver bit holder. Or a slit gap is kept between the rear end of driver bit holder and rear wall of mounting position. Front end of pushrod coincides with slit gap when pushbutton set is located at the rear part of slideway. This situation is especially suitable for the engagement structure of magnetic engagement, so when driver bit is pulled back into containing hole relying on engagement structure of magnetic engagement, and even the rear end of driver bit is extended out of containing hole, driver bit holder can still be rotated to detach driver bit and pushrod and driver bit can be kept in containing hole. Further, in order to prevent exposure of driver bit out of containing hole, the aforementioned elastic structure 26 can be simultaneously arranged at the inner wall of containing hole 22 in this situation.

Figure 36:
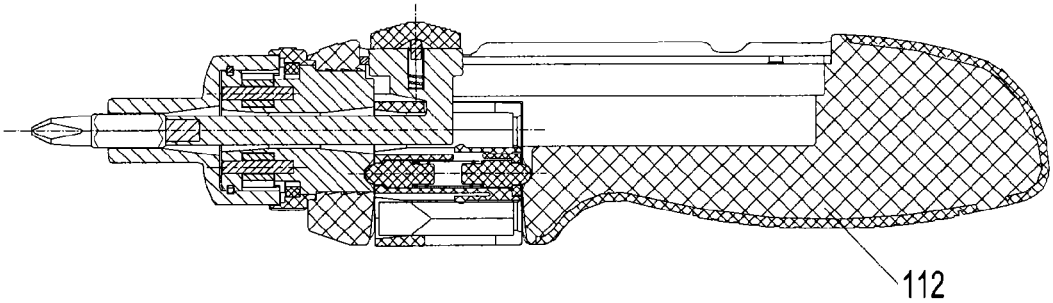
FIG. 36 is a sectional structural schematic view of another preferred embodiment of the screwdriver with a driver bit which can be pushed out smoothly in accordance with the present disclosure.

FIG. 36 is a sectional structural schematic view of another preferred embodiment of the present disclosure, different from the aforementioned embodiment whose handle gripping portion 111 is revolver type, the handle gripping portion 112 of the present embodiment is a straight handle. Surely, it can be understood by the ordinary person skilled in the area, the present disclosure is also applicable to situations where handle has other forms.

The foregoing embodiment describes the inventive concept of the present disclosure. In a specific embodiment, it is not limited to the case, first guiding segment 11*b*, guiding surface 11*c*, transition surface 11*d* referred to in the present disclosure can also be applied to the driver bit sleeve publicized in U.S. Pat. No. 6,134,995A, U.S. Pat. No. 6,138,537A, U.S. Pat. No. 7,028,593B1, the referred flaring 22*a* can also be applied to the driver bit holder publicized in U.S. Pat. No. 6,134,995A, U.S. Pat. No. 6,138,537A, U.S. Pat. No. 7,028,593B1.

Preferred embodiments of the present disclosure have been described above. It should be understood that many modifications and variations can be made by ordinary technician of the field according to conception of present disclosure without creative labor. Therefore, all the technical schemes obtained through logical analysis, deductions or limited experimentation based on the present disclosure by technicians of the field are within the scope of the claims.

What is claimed is:

1. A screwdriver, including a driver bit sleeve, wherein an inner hole of said driver bit sleeve is arranged to receive a driver bit in a working position, the inner hole includes a torque transmission segment located in a front part and a first guiding segment located in a rear part, and an inner wall of said first guiding segment is arranged as a guiding surface;

wherein the screwdriver also includes a revolving wheel-shaped driver bit holder, said revolving wheel-shaped driver bit holder is rotatably arranged at a rear side of said driver bit sleeve, on said revolving wheel-shaped driver bit holder is a distributed axial containing hole which contains a driver bit, said containing hole can rotate to axially coincide with the inner hole of said driver bit sleeve, and a front end of said containing hole is arranged with flaring;

wherein a front side of said revolving wheel-shaped driver bit holder is arranged with a ratchet structure, said driver bit sleeve is arranged on said ratchet structure, a through hole which is co-axial with the inner hole of said driver bit sleeve is arranged on said ratchet structure, said containing hole can rotate to axially coincide with said through hole and the inner hole of said driver bit sleeve; a front end of said through hole is arranged with flaring.

2. The screwdriver according to claim 1, wherein said guiding surface can be a conical surface which defines said first guiding segment into a conical hole segment, and the diameter of a rear end of said conical hole segment is larger than that of a front end thereof.

3. The screwdriver according to claim 1, wherein the inner hole of said driver bit sleeve includes a transition surface which is located between said torque transmission segment and said first guiding segment, and which connects said torque transmission segment and said first guiding segment.

4. The screwdriver according to claim 1, wherein a rear end of said through hole is arranged as a second guiding segment.

5. The screwdriver according to claim 4, wherein said second guiding segment arranged at said rear end of said through hole is a conical hole segment.

6. The screwdriver according claim 1, wherein the screwdriver also includes a pushrod which can slide from a first position to a second position, when said pushrod is at said second position, said pushrod is located at a rear side of said revolving wheel-shaped driver bit holder and axially coincides with the inner hole of said driver bit sleeve.

7. The screwdriver according to claim 1, wherein the screwdriver includes:

a handle having a front end of which is arranged with said driver bit sleeve, a slit which is arranged extending forward and backward is provided at a position located at the rear of said driver bit sleeve on said handle, a mounting position is visible through said slit, a slideway is arranged at the edge of said slit, a first positioning portion is arranged at a front part of said slideway;

said revolving wheel-shaped driver bit holder has an axial direction that is along the same front-rear direction as that of said handle and is rotatably mounted at said mounting position;

a pushrod, which is disposed in said handle along the front-rear direction and axially coincides with the inner hole of said driver bit sleeve;

a pushbutton set, which is assembled with said pushrod and slidably mates on said slideway, and which can be positioned at said first positioning portion;

wherein said containing hole is a plurality of containing holes, when said pushbutton set is positioned at said first positioning portion, said pushrod gets into one of said plurality of containing holes of said revolving wheel-shaped driver bit holder, pushing a driver bit in said one of said plurality of said containing holes toward said driver bit sleeve until said driver bit extends out of said driver bit sleeve, when said pushbutton set is positioned at a rear part of said slideway, said pushrod is positioned at a rear side of said revolving wheel-shaped driver bit holder.

8. The screwdriver according to claim 7, wherein the front end of said handle is arranged with said ratchet structure.

9. The screwdriver according to claim 8, wherein said ratchet structure includes a pawl seat, a ratchet sleeve and a rotary sleeve:

said pawl seat is fixed at the front end of said handle, said pawl seat is arranged with two opposite swingable pawls and thumb piece for controlling the position status of said two opposite swingable pawls, said thumb piece has two thumb nubble corresponding to said two opposite swingable pawls, respectively;

said ratchet sleeve is set on said pawl seat for gearing with said pawl;

said rotary sleeve is set at an outside of said pawl seat and connects said thumb piece;

said driver bit sleeve is arranged on said ratchet sleeve, and said through hole is provided on said pawl seat.

10. The screwdriver according to claim 9, further comprising an inner wall of said rotary sleeve that has three positioning recesses, wherein said pawl seat is arranged with positioning a pin tumbler thereon, and wherein said positioning pin tumbler is supported by an elastic element and located in one of said three positioning recesses.

11. The screwdriver according to claim 9, wherein said opposite swingable two pawls have an elastic element supported in between, which keeps said two opposite swingable pawls open and leaning toward said ratchet sleeve.

12. The screwdriver according to claim 7, wherein said front end of said handle is arranged with a structural member, and wherein said driver bit sleeve is arranged on said structural member.

13. The screwdriver according to claim 7, wherein said slideway is metallic piece.

14. The screwdriver according to claim 7, wherein said first positioning portion is a gap arranged on said slideway.

15. The screwdriver according to claim 14, further comprising a tail part of said pushrod that extends toward a direction of said slideway and out of a base portion, wherein said pushbutton set includes a locking plate, a touch button and an elastic element, wherein said locking plate is moveably disposed at said base portion along the direction, along which said base portion extends, and within a moveable area thereof said locking plate can snap into said gap and detach from said gap, wherein said elastic element is positioned between said locking plate and said base portion, pressing said locking plate toward inside of said gap with elastic force, and wherein said touch button is assembled on said base portion slidably in front-rear direction and is arranged thereon with a touch portion which forces said locking plate to act.

16. The screwdriver according to claim 15, further comprising a supporting portion which supports said pushrod that is arranged in said handle along the direction, along which said slideway extends.

17. The screwdriver according to claim 16, wherein the rear part of said slideway is arranged with a second positioning portion for positioning said pushbutton set.

18. The screwdriver according to claim 17, wherein a structure of said second positioning portion is identical to a structure of said first positioning portion, said pushrod is located at the rear side of said revolving wheel-shaped driver bit holder when said pushbutton set is positioned at said second positioning portion.

19. The screwdriver according to claim 14, further comprising a tail part of said pushrod that extends toward a direction of said slideway and out of a base portion, wherein said pushbutton set includes a touch button and an elastic element, wherein said touch button is arranged with a locking stop flange thereon, wherein said touch button is moveably disposed at said base portion along the direction, along which said base portion extends; and within the moveable area of said touch button, wherein said locking stop flange can snap into said gap and detach from said gap, and wherein said elastic element is positioned between said touch button and said base portion, pressing said locking stop flange toward inside of said gap with elastic force.

20. The screwdriver according to claim 7, wherein the rear part of said slideway is arranged with a second positioning portion for positioning said pushbutton set.

21. The screwdriver according to claim 20, wherein a structure of said second positioning portion is identical to a structure of said first positioning portion, and wherein said pushrod is located at the rear side of said revolving wheel-shaped driver bit holder when said pushbutton set is positioned at said second positioning portion.

22. The screwdriver according to claim 7, further comprising a front wall of said mounting position and a front end of said revolving wheel-shaped driver bit holder, and a rear wall of said mounting position and a rear end of said revolving wheel-shaped driver bit holder, are arranged with a pit and a telescopic shaft head, respectively, wherein an elastic element is supported at a rear end of said telescopic shaft head and said telescopic shaft head is located in a corresponding pit to actualize the mounting of said revolving wheel-shaped driver bit holder at said mounting position.

23. The screwdriver according to claim 7, further comprising a front wall or/and a rear wall of said mounting position, and a front end or/and a rear end of said revolving wheel-shaped driver bit holder are arranged with a positioning pin tumbler and a positioning recess, respectively, wherein an elastic element is supported at a rear end of said positioning pin tumbler, and wherein said positioning pin tumbler is located in said positioning recess to actualize the positioning of said revolving wheel-shaped driver bit holder on said handle.

24. The screwdriver according to claim 7, further comprising an inner wall of said containing hole that has elastic structure.

25. The screwdriver according to claim 7, wherein said revolving wheel-shaped driver bit holder has a driver bit sign on positions that correspond to each containing hole.

26. The screwdriver according to claim 7, wherein said revolving wheel-shaped driver bit holder is transparent.

27. The screwdriver according to claim 7, wherein said handle is arranged with a containing portion thereon for storing a backup driver bit holder.

28. The screwdriver according to claim 7, wherein said handle is arranged with a backup driver bit storage holder thereon.

29. The screwdriver according to claim 7, wherein said handle has a gripping portion extending toward a side of said pushrod.

30. The screwdriver according to claim 7, further comprising a front end of said pushrod or/and said driver bit that are arranged with engagement structures thereon for the engagement of said both, wherein said pushrod is located at the rear side of said revolving wheel-shaped driver bit holder when said pushbutton set is located at the rear part of said slideway, and brings the corresponding driver bit back into a corresponding containing hole of said plurality of containing holes relying on said engagement structures.

31. The screwdriver according to claim 30, wherein said engagement structures are magnetic structures provided for both of said front end of said pushrod or/and said driver bit to adhere to.

32. The screwdriver according to claim 30, wherein said engagement structures are tenon and mortise arranged at said front end of said pushrod and a rear end of said driver bit respectively.

33. The screwdriver according to claim 7, further comprising a rear end of each containing hole that has a blocking portion.

34. The screwdriver according to claim 7, further comprising a slit gap that is arranged between a rear end of said revolving wheel-shaped driver bit holder and a rear wall of said mounting position, and a front end of said pushrod that coincides with said slit gap when said pushbutton set is located at rear part of said slideway.

35. A screwdriver, including a handle having a front end that is arranged with a driver bit sleeve, wherein:

an inner hole of said driver bit sleeve includes a torque transmission segment located in a front part thereof and a first guiding segment located in a rear part thereof, and an inner wall of said first guiding segment is arranged as a guiding surface;

further includes a revolving wheel-shaped driver bit holder, said revolving wheel-shaped bit holder is rotatably arranged at a rear side of said driver bit sleeve, on said revolving wheel-shaped driver bit holder is a distributed axial containing hole which contains a driver bit, said containing hole can rotate to axially coincide with the inner hole of said driver bit sleeve;

a front side of said revolving wheel-shaped driver bit holder is arranged with a ratchet structure, said driver bit sleeve is arranged on said ratchet structure, a through hole which is co-axial with the inner hole of said driver bit sleeve is arranged on said ratchet structure, said containing hole can rotate to axially coincide with said through hole and said inner hole of said driver bit sleeve, a front end of said through hole is arranged with flaring, a rear end of said through hole is arranged as second guiding segment.

36. The screwdriver according to claim 35, further comprising a front end of said containing hole on said revolving wheel-shaped driver bit holder is arranged with flaring, and a rear end of said containing hole has a blocking portion.

37. The screwdriver according to claim 35, wherein said handle is a revolver type handle or a straight handle.

* * * * *